US011053655B2

(12) United States Patent
Maxwell

(10) Patent No.: US 11,053,655 B2
(45) Date of Patent: Jul. 6, 2021

(54) MODULAR GRID FOUNDATION

(71) Applicant: Lawrence S. Maxwell, Pearland, TX (US)

(72) Inventor: Lawrence S. Maxwell, Pearland, TX (US)

( * ) Notice: Subject to any disclaimer, the term of this patent is extended or adjusted under 35 U.S.C. 154(b) by 10 days.

(21) Appl. No.: 16/417,501

(22) Filed: May 20, 2019

(65) Prior Publication Data

US 2019/0271133 A1 Sep. 5, 2019

Related U.S. Application Data

(63) Continuation-in-part of application No. 14/164,963, filed on Jan. 27, 2014, now Pat. No. 10,435,858.
(Continued)

(51) Int. Cl.
*E02D 27/14* (2006.01)
*E02D 5/24* (2006.01)
(Continued)

(52) U.S. Cl.
CPC ..... *E02D 27/14* (2013.01); *E02D 5/24* (2013.01); *E02D 7/02* (2013.01); *E02D 13/00* (2013.01);
(Continued)

(58) Field of Classification Search
CPC ..... E04H 12/2215; E02D 5/04; E02D 5/06; E02D 5/08; E02D 5/28; E02D 5/285;
(Continued)

(56) References Cited

U.S. PATENT DOCUMENTS 798,945 A * 9/1905 Berntson ..... E04H 12/2215 52/154
844,294 A * 2/1907 Winslow ..... E02D 5/80 52/155
(Continued)

FOREIGN PATENT DOCUMENTS

CA 2838434 A1 * 7/2014 ..... E02D 5/06
DE 2207543 A1 * 8/1973 ..... E02D 5/04
(Continued)

OTHER PUBLICATIONS

Machine Translation of DE2207543; http://translationportal.epo.org/emtp/translate/?ACTION=description-retrieval&COUNTRY=DE&ENGINE=google&FORMAT=docdb&KIND=A1&LOCALE=en_EP&NUMBER=2207543&OPS=ops.epo.org/3.2&SRCLANG=de&TRGLANG=en; Oct. 15, 2018 (Year: 2018).‡

*Primary Examiner* — Ryan D Kwiecinski
(74) *Attorney, Agent, or Firm* — Polsinelli PC

(57) ABSTRACT

Method of building a grid system wherein a plurality of modular apparatuses can be arranged at a structure site. The plurality modular apparatuses can have a central tubular member having an inner bore formed between a proximal end and a distal end, and a plurality of vanes having a lateral width at least equal to a diameter of the central tubular member. The one or more modular apparatuses can be positioned above a surface of the structure site. Each of the plurality modular apparatuses can be connected with at least two adjacent modular apparatuses of the plurality of modular apparatuses via a locking lug on one of the plurality of vanes slidingly engaged with a locking channel on an adjacent modular apparatus. The plurality of modular apparatuses can then be driven into the structure site wherein the inner bore receives earthen formation therein.

19 Claims, 11 Drawing Sheets

Related U.S. Application Data

(60) Provisional application No. 62/791,501, filed on Jan. 11, 2019, provisional application No. 62/673,696, filed on May 18, 2018, provisional application No. 61/872,907, filed on Sep. 3, 2013.

(51) Int. Cl.
*E02D 7/02* (2006.01)
*E02D 13/00* (2006.01)

(52) U.S. Cl.
CPC .. *E02D 2200/16* (2013.01); *E02D 2300/0051* (2013.01); *E02D 2600/20* (2013.01)

(58) Field of Classification Search
CPC .... E02D 5/54; E02D 5/80; E02D 7/02; E02D 7/04; E02D 7/06; E02D 7/18; E02D 27/12; E02D 27/16; E02D 27/42; E02D 27/425; E02D 27/14; E02D 5/24; E02D 13/00; E02D 2300/0051; E02D 2200/16; E02D 2600/20
See application file for complete search history.

(56) References Cited

U.S. PATENT DOCUMENTS 865,080 A * 9/1907 Candee ..... E02D 5/04 405/280
909,548 A * 1/1909 Cluxton ..... E02D 5/04 405/277
3,059,436 A * 10/1962 Hermann, Jr. ..... E02D 5/04 405/278
3,342,444 A * 9/1967 Nelson ..... E04H 12/2215 52/165
5,106,233 A * 4/1992 Breaux ..... B09B 1/008 405/129.8
5,984,587 A * 11/1999 Odle ..... E01F 9/685 248/530
6,427,402 B1 * 8/2002 White ..... E02D 5/08 405/241
7,150,584 B2 * 12/2006 Nishiyama ..... E02D 5/06 405/274
7,530,176 B2 * 5/2009 Shotton ..... E02D 13/04 33/302
10,435,858 B2 * 10/2019 Maxwell ..... E02D 5/285
2003/0152427 A1 * 8/2003 Nickelson ..... E02D 19/185 405/129.25
2005/0063784 A1 * 3/2005 Nickelson ..... B23K 5/006 405/129.57
2005/0232707 A1 * 10/2005 Reinert, Sr. ..... E02D 27/42 405/232
2005/0254905 A1 * 11/2005 Nishiyama ..... E02D 5/06 405/274
2012/0177445 A1 * 7/2012 Wendt ..... E02D 5/28 405/211.1
2012/0192508 A1 * 8/2012 Burdine ..... E02D 5/80 52/155
2012/0269583 A1 * 10/2012 Heindl ..... E02D 5/08 405/251
2013/0160694 A1 * 6/2013 Lieng ..... B63B 21/26 114/304
2014/0237913 A1 * 8/2014 Kronz ..... E02D 5/28 52/169.9
2016/0168816 A1 * 6/2016 Pope ..... E02D 5/223 52/292

FOREIGN PATENT DOCUMENTS

DE 102006041049 A1 * 3/2008 ..... E02B 3/106
FR 790907 A * 11/1935 ..... E02D 5/28
GB 2138048 A * 10/1984 ..... E04H 12/2215
JP 60133116 A * 7/1985 ..... E02D 5/08
WO WO-2010133380 A1 * 11/2010 ..... E02D 5/06
WO WO-2011125347 A1 * 10/2011 ..... E02D 5/08
WO WO-2012096932 A1 * 7/2012 ..... E02D 5/285
WO WO-2017060567 A1 * 4/2017 ..... E02D 5/08

* cited by examiner
‡ imported from a related application

MODULAR GRID FOUNDATION

CROSS-REFERENCE TO RELATED APPLICATIONS

This application is a continuation in part of U.S. application Ser. No. 14/164,963, filed Jan. 27, 2014, and claims the benefit of U.S. Provisional Application No. 62/673,696, filed May 18, 2018, and U.S. Provisional Application No. 62/791,501, filed Jan. 11, 2019, the contents of which are each incorporated by reference herein in their entirety.

FIELD

The present technology is directed to an apparatus, system, and method for a modular grid foundation.

BACKGROUND

Traditional concrete foundations are very expensive, and the utilization of concrete for a foundation is subject to many restrictions. Many factors that affect installation time are beyond the control of a contractor (e.g weather, soil conditions, etc.). Notwithstanding the uncontrollable factors, there is no way around the enormous amount of time required to complete the arduous twenty-plus step on-site process to build a concrete foundation.

BRIEF DESCRIPTION OF THE DRAWINGS

The embodiments herein may be better understood by referring to the following description in conjunction with the accompanying drawings in which like reference numerals indicate analogous, identical, or functionally similar elements. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure. Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

The present disclosure is drawn to an apparatus, system, and method for modular grid foundations that resist environmental breakdown. The system of the present disclosure implements a plurality of foundation modules arranged in a predetermined grid and driven into an earthen formation via a mechanical force. The plurality of foundation modules can be coupled one to the other, thereby trapping earthen formation within the predetermined grid and allowing the system to resist overturning, uplifting, settling, etc. The foundation modules can include a central tubular member having a plurality of vanes extending therefrom. The plurality of vanes can have coupling mechanisms disposed at distal ends operable to engage adjacent foundation modules or modular foundation systems. The plurality of vanes can extend away from the central tubular member a predetermined distance to secure sufficient earthen formation within the predetermined grid.

Each element of the foundation system can be operable disposed within an earthen formation (or structure site) with a predetermined mechanical force and/or driven to a predetermined depth. In some instances, the predetermined mechanical force can be "refusal," being defined as the mechanical force (e.g. excavator) unable to drive the foundation system element further, such as lifting off the ground and/or stalling.

The foundation system as described herein is modular allowing implementation with one or more components depending on the desired application and need. The modular foundation system can be adapted to specific job requirements including, but not limited to, elevational needs, soil structure, environmental conditions, and the like.

Further, the modular foundation system as described herein can be filled with earthen material, concrete, and/or any other material depending on the foundational and/or situational requirements.

Figure 1:
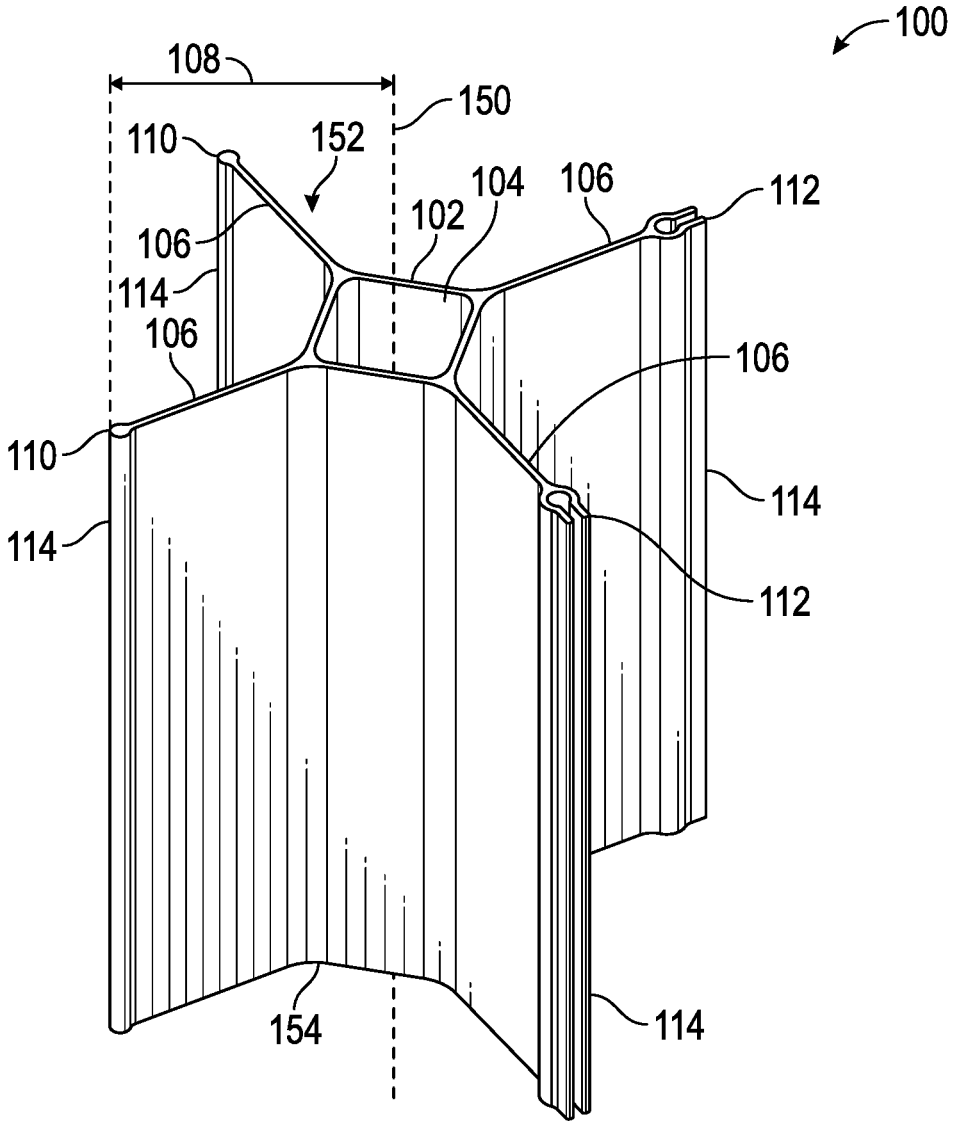
FIG. 1 is an isometric view of a foundation module, according to at least one instance of the present disclosure.

FIG. 1 illustrates a foundation module according to at least one instance of the present disclosure. The foundation module 100 can include a central tubular member 102 having an inner bore 104 formed along a longitudinal length 150. The longitudinal length 150 can extend between a proximal end 152 and a distal end 154 of the central tubular member 102. The foundation module 100 can extend along the longitudinal length 150 a predetermined distance depending on the desired application including, but not limited to, soil conditions, building height, building weight, etc. While the inner bore 104 of the central tubular member 102 is shown having a substantially rectangular cross-section, the inner bore 104 can implement any desired cross-sectional shape including, but not limited to, circular, ovular, hexagonal, and the like.

The foundation module 100 can include a plurality of vanes 106 extending therefrom. The plurality of vanes 106 can extend a predetermined distance 108 away from the central tubular member 102 of the foundation module 100. The predetermined distance 108 can be determined by the desired application. In at least one instance, the predetermined distance 108 can be at least equal to a cross-sectional diameter of the central tubular member 102.

The plurality of vanes 106 can extend along the longitudinal length 150 of the central tubular member 102. In at least one instance, the plurality of vanes 106 can extend substantially from the proximal end 152 to the distal end 154. In other instances, the plurality of vanes 106 can extend for a portion of the longitudinal length 150 truncating prior to the proximal end 152 and/or truncate prior to the distal end 154. In some instances, the plurality of vanes 106 can extend substantially from the proximal end 152 to the distal end 154 with the predetermined distance 108 tapering at either of the proximal end 152 and/or the distal end 154.

The plurality of vanes 106 can be symmetrically disposed around the central tubular 102, such that an angle formed between any two adjacent vanes 106 is substantially equal to an angle formed between any two other adjacent vanes 106. The plurality of vanes 106 can include a disposed at a distal end 114 of the predetermined distance 108. The coupling mechanisms can be a lug 110, a locking channel 112, and/or combinations thereof.

The foundation module 100 can have four vanes 106 extending from the central tubular member 102. The four vanes 106 can be symmetrically disposed around the central member 102 at substantially ninety-degree (90) angles formed between adjacent vanes 106. Each of the four vanes 106 can extend the predetermined distance 108 away from the central tubular member 102, and can have substantially the same predetermined distance 108.

In other instances, each of the plurality of vanes 106 can have varying predetermined distances 108 depending on the structure and/or arrangement. For example, a first group of plurality of vanes 106 can have a first predetermined distance 108 extending away from the central tubular member 102 and a second group can have a second predetermined distance 108 extending away from the central tubular member 102. The first group and the second group of plurality of vanes 106 can be disposed around the central tubular member 102 in any order, combination, and/or arrangement.

Figure 6:
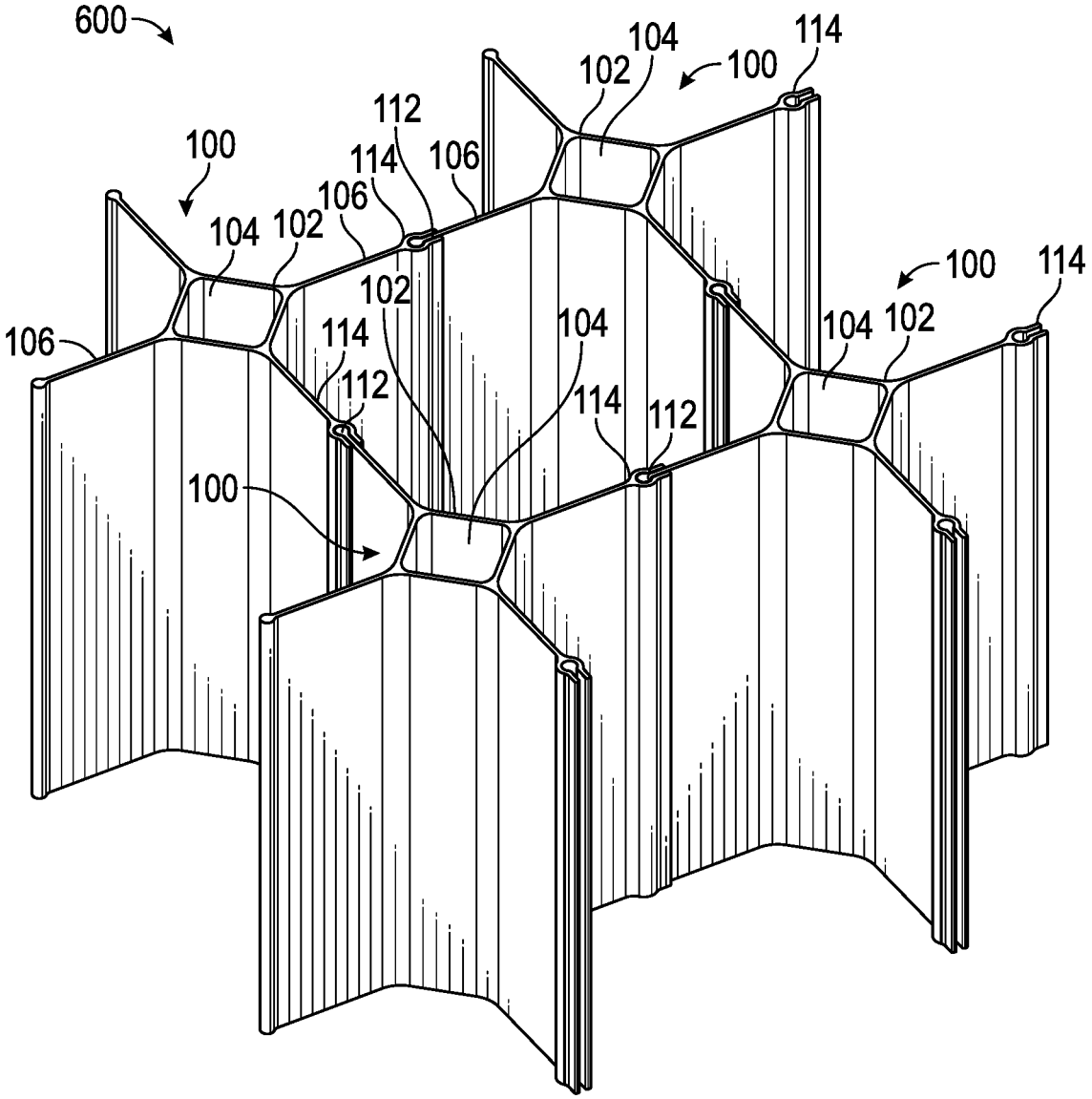
FIG. 6 is a top isometric view of a modular grid foundation system, according to at least one instance of the present disclosure.
Figure 7:
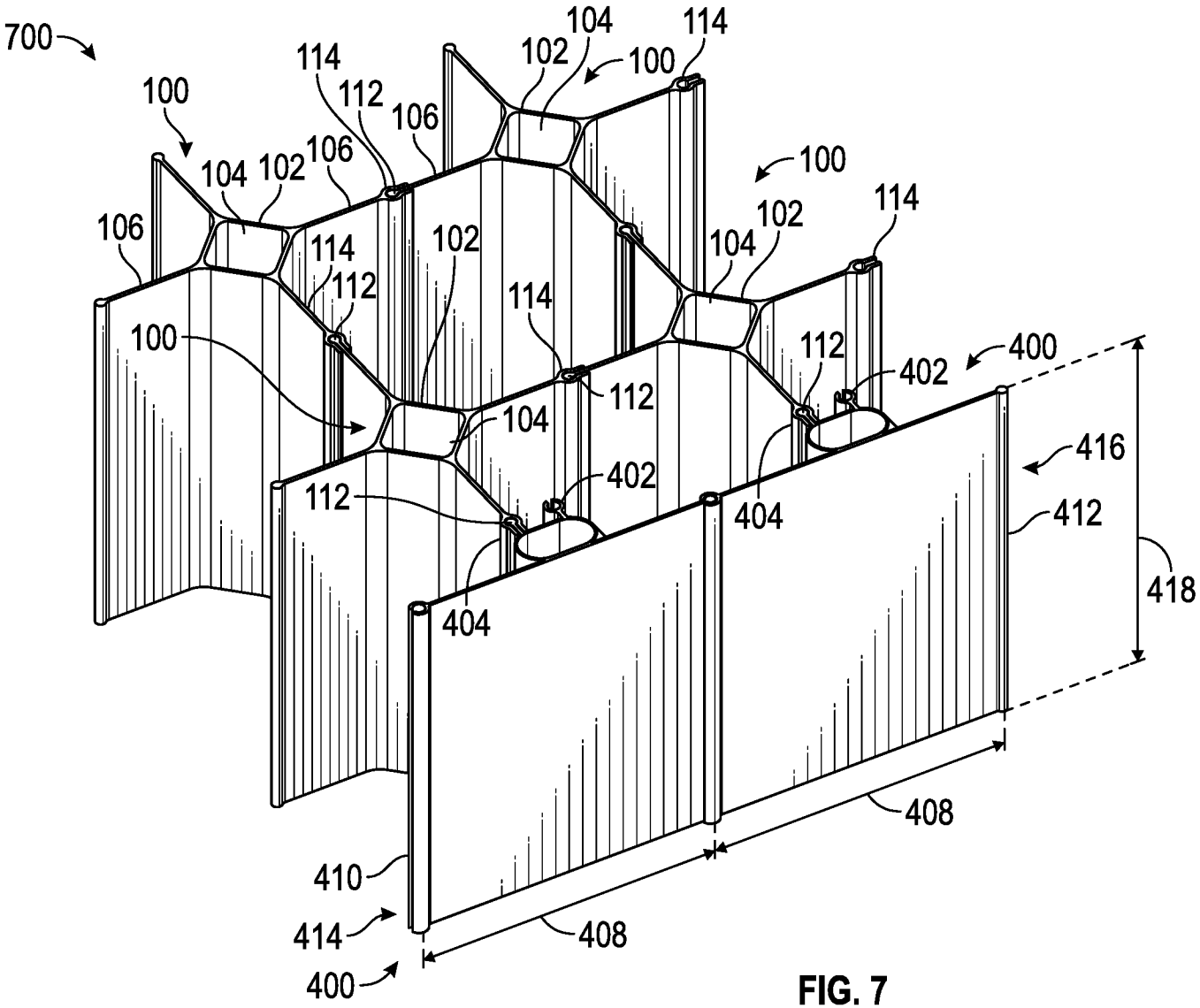
FIG. 7 is an isometric view of a modular grid foundation system coupled with a plurality of wall panels, according to at least one instance of the present disclosure.

The foundation module 100 can operably link to adjacent foundation modules (as shown in FIGS. 6 and 7) to form a modular grid foundation system. The modular grid foundation system can resist movement in any direction (e.g. a horizontal (x-y plane), a vertical (z plane)). The interlocking of a plurality of foundation modules 100 in a grid arrangement can trap and/or retain earthen formation between the plurality of vanes 106 of adjacent foundation modules. The trapped earthen formation within the grid of plurality of foundation modules 100 can prevent compression, overturning, uplifting, shear, and/or settlement of the foundation.

The foundation modules 100 can be formed of fiber-reinforced polymers, steel, aluminum, carbon composites, composites, and/or combinations thereof. The foundation modules 100 can be driven into an earthen formation to a sufficient and/or predetermined depth necessary to confine enough earthen formation between the plurality of vanes. In at least one instance, upon installation of the foundation modules 100 to the predetermined depth, the foundation modules 100 can be cut and/or severed to be substantially flush with the surface of the earth. In other instances, the foundation modules 100 can be cut and/or severed at a predetermined height above the surface of the earth.

Figure 2:
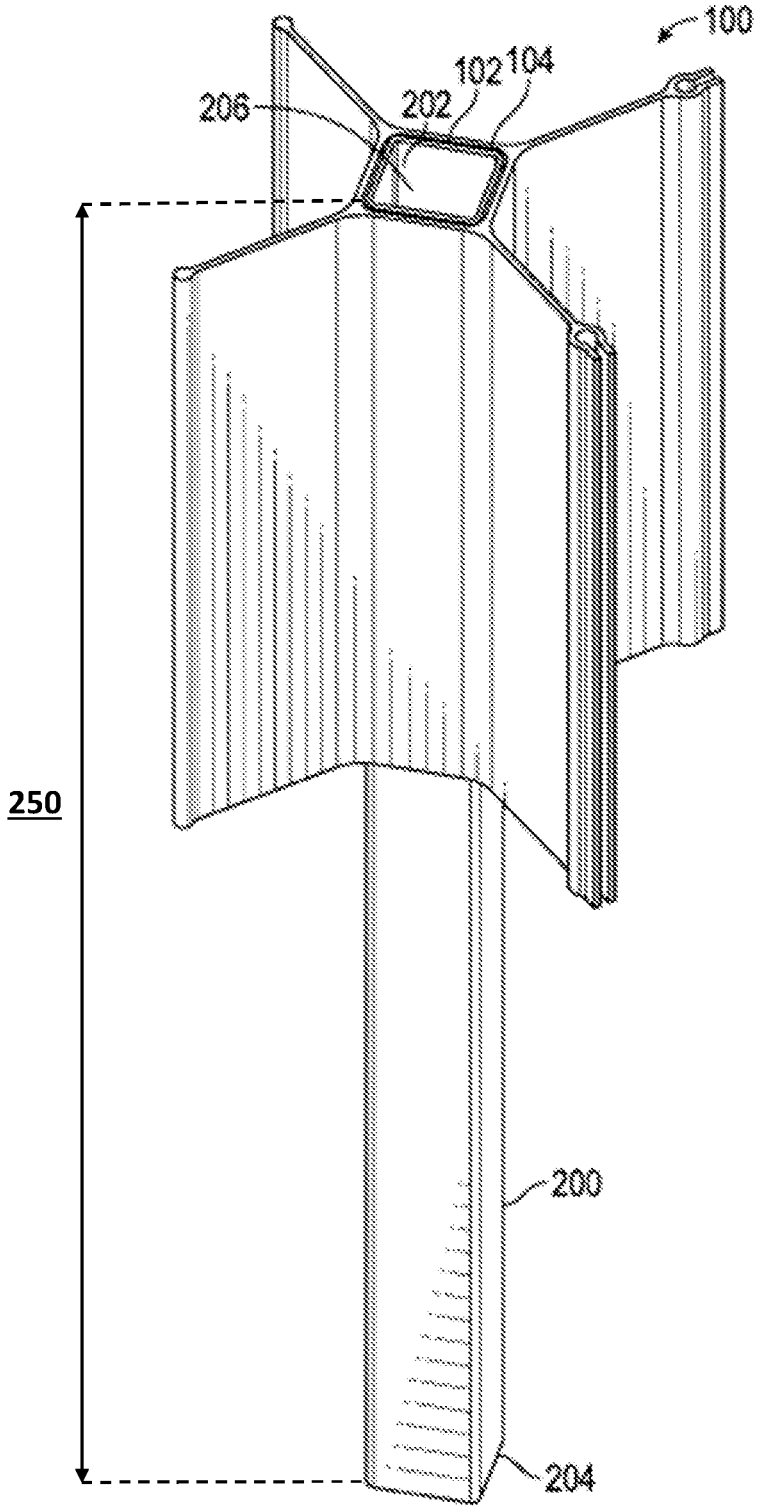
FIG. 2 is an isometric view of a foundation module having a stanchion sleeve received therein, according to at least one instance of the present disclosure.

FIG. 2 illustrates a foundation module having a stanchion sleeve received therein. The foundation module 102 can operably receive a stanchion 200 therein. The stanchion 200 can be received into and/or through at least a portion of the inner bore 104 and extend therefrom. In at least one instance, the stanchion 200 can extend a predetermined distance beyond the distal end 154 of the foundation module 100. In other instances, the stanchion 200 can extend a predetermined distance beyond the proximal end 152 of the foundation module 100 and/or a predetermined distance beyond the distal end 154 of the foundation module 100.

The stanchion 200 can be passed through and received into the inner bore 104. The stanchion 200 can have a smaller cross-sectional area than the inner bore 104, thereby allowing an sliding engagement therebetween. The stanchion 200 can have a substantially similar cross-sectional arrangement to that of the inner bore 104. In other instances, the stanchion 200 can have a different cross-sectional arrangement to that of the inner bore 104 with at least a portion of the stanchion 200 engaging at least a portion of the inner bore 104. In at least one instance, the stanchion 200 can have a substantially square cross-sectional area and the inner bore can be substantially circular and/or ovular, thereby allowing the stanchion 200 to sliding engage therewith while allowing sidewall contact between the stanchion 200 and the inner bore 104 to prevent longitudinal and/or lateral movement of the stanchion relative to the central tubular member 102.

The stanchion 200 can have a proximal end 202 and a distal end 204. After receipt into the foundation module 100, the distal end 204 can extend beyond the distal end 154 of the central member 102 and the proximal end 202 can be substantially even and/or flush with the proximal end 152 of the foundation module 100.

The stanchion 200 can have an inner bore 206 formed along the longitudinal length 250 thereof. The inner bore 206 can operably receive earthen formation therein and allow the formation of a compressed bell bottom, as described further with respect to FIG. 3. The inner bore 206 can allow for easier installation of the stanchion within the earthen formation while simultaneously allowing the formation of the compressed bell bottom.

Figure 3:
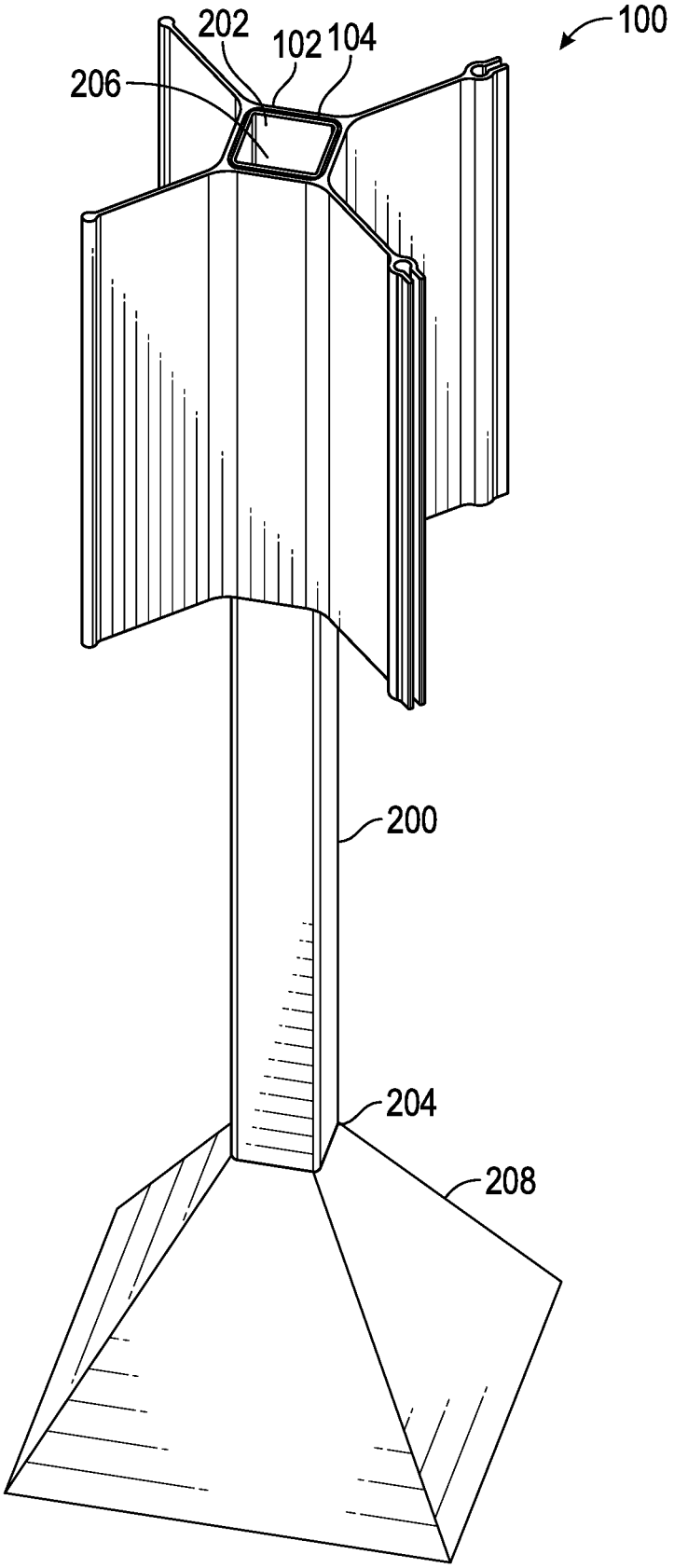
FIG. 3 is an isometric view of a foundation module having a stanchion sleeve received therein and a compressed bell bottom formed at a distal end, according to at least one instance of the present disclosure.

FIG. 3 illustrates a foundation module having a stanchion sleeve received therein with a compressed bell bottom. The stanchion 200 can be installed within the foundation module 100 within an earthen environment. After installation of the stanchion 200 within the foundation module 100, material can be disposed within and/or compacted within the stanchion inner bore 206, thus forming a compressed bell bottom 208. The compressed bell bottom 208 can be formed by compaction of material through the longitudinal length of the stanchion 200. The compressed bell bottom 208 can be formed when the volume and density of compacted material resists the compressive load, thus entering "refusal." Refusal can be defined as when the predetermined mechanical driving force (e.g. excavator, pile driver, etc.) is resisted by the stanchion, such that the mechanical driving force stalls, lifts, or otherwise is unable to compact material further.

The compressed bell bottom 208 can increase resistance to compressive loads. In at least one instance, the compressed bell bottom 208 can be formed within a clay layer of the earthen formation. The compressed bell bottom 208 can be formed by clearing and backfilling the stanchion inner bore 206 with material and followed by application of a mechanical force, thereby compressing the material past the distal end 206 of the stanchion 200 and forming the compressed bell bottom 208.

While FIG. 3 illustrates a compressed bell bottom 208 formed at the distal end 204 of the stanchion 200, it is within the scope of this disclosure to implement a compressed bell bottom 208 at the distal end of a stanchion 200, a module 100, and/or combinations thereof.

Figure 4:
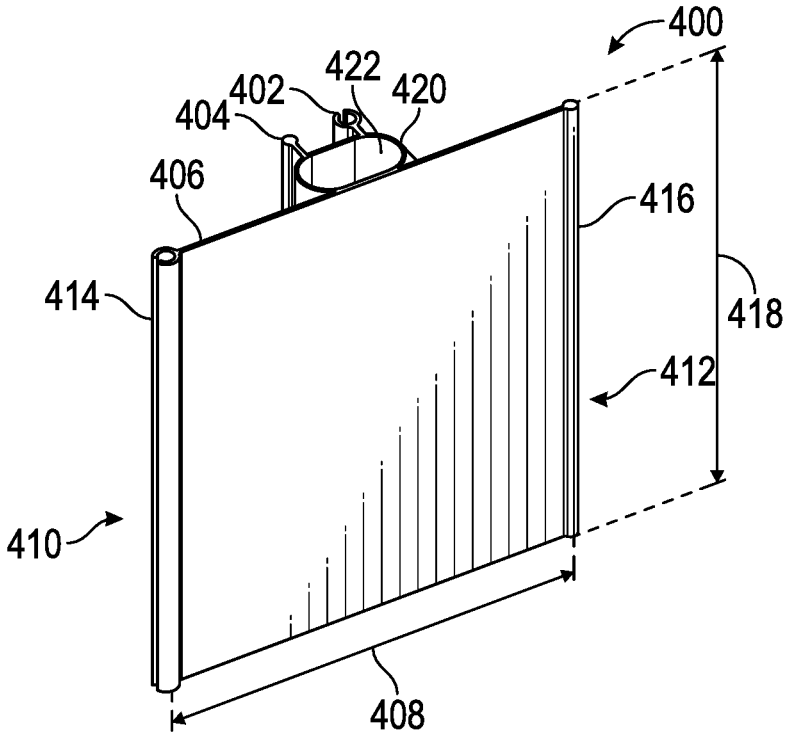
FIG. 4 is an isometric view of a wall panel, according to at least one instance of the present disclosure.
Figure 5:
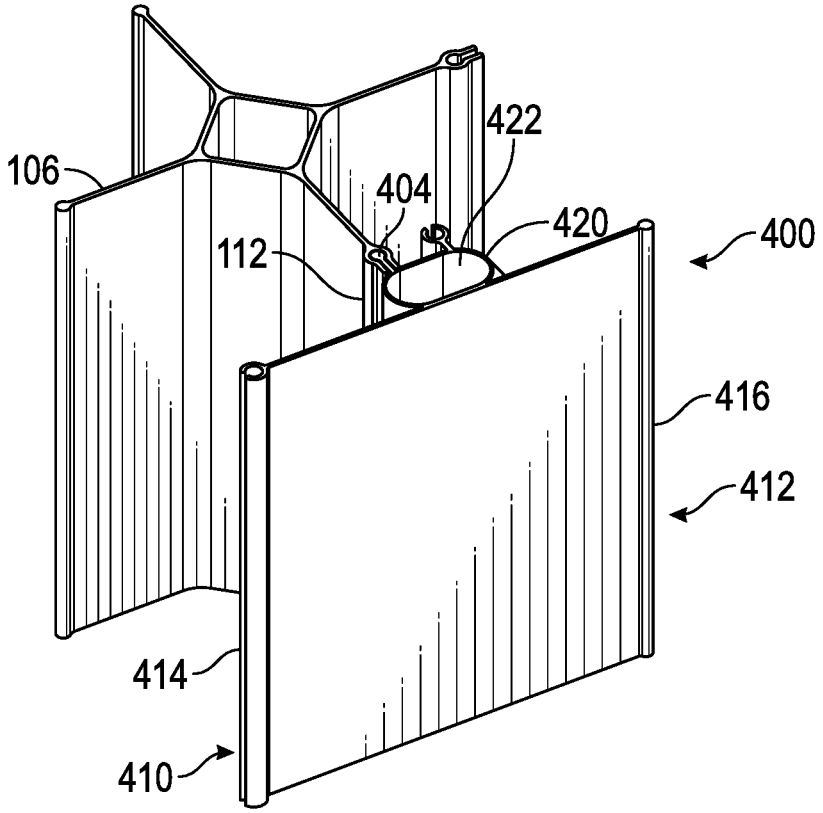
FIG. 5 is an isometric view of a foundation module coupled with a wall panel, according to at least one instance of the present disclosure.

FIG. 4 illustrates a wall panel for use with a modular grid foundation system including one or more foundation modules. The wall panel 400 can be implemented with one or more foundation modules 100, thereby providing a substantially smooth and/or flush surface. The wall panel 400 can be coupled with one or more the coupling mechanisms of the plurality of vanes 106 of the foundation module 100. The wall panel 400 can include a locking channel 402 and a locking lug 404 disposed on an interior surface 406 thereof. The locking channel 402 and the locking lug 404 can coupled the wall panel 400 with the foundation module 100, respectively (as shown in FIG. 5).

The foundation module 100 can couple with one of the locking channel 402 and the locking lock 404 via one of the coupling the mechanisms, thereby coupling the wall panel 400 with the foundation module 100.

The wall panel 400 can have a width 408 substantially equal to the width of a foundation module 100 and a height 418. The width 408 can extend between a proximal edge 410 and a distal edge 412, and the wall panel 400 can have a coupling mechanism disposed on each of the proximal edge 410 and the distal edge 412. In at least one instance, the wall panel 400 can have a locking channel 414 on one of the proximal edge 410 and the distal edge 412 and a locking lug 416 on the other of the proximal edge 410 and the distal edge 412.

The height 418 can extend along the longitudinal length 150 of the foundation module 100. The locking channel 414 and the locking lug 416 can extend along the height 418. The locking channel 414 and the locking lug 416 can allow coupling between adjacent wall panels 400 one to the next.

As can be appreciated in FIG. 5, the wall panel 400 can be coupled with a foundation module 100. The wall panel 400 can be coupled with the foundation module 100 via one of the locking channel 402 or the locking lug 404 coupled with a corresponding locking lug 110 or locking channel 112 of the foundation module 100. In at least one instance, the locking channel 402 and the locking lug 404 are lateral spaced along the width 408. The wall panel 400 can be coupled with corresponding the locking lug 110 or the locking channel 112 depending on the arrangement of the foundation module 100.

As can be appreciated in FIGS. 4 and 5, the wall panel 400 can further include a tubular channel 420 extending along the predetermined height 418. The tubular channel 420 can have an inner bore 422 formed therein and operable to receive a stanchion 200. The wall panel 400 can have a stanchion 200 disposed within the tubular channel 420 as needed depending the particular application and/or environment.

A foundation system can be formed by grid of foundation modules 100 (shown more clearly in FIG. 6) and a plurality of wall panels 400 can be coupled with an exterior array of foundation modules 100. Each of the plurality of wall panels 400 can individually coupled with a corresponding foundation module 100 via one of the locking channel 402 or the locking lug 404 and the corresponding locking channel or locking lug of the foundation module 100. In at least one instance, each of the plurality of wall panels 400 is coupled with the same corresponding locking channel 112 and/or locking lug 110 on the corresponding foundation module.

FIG. 6 illustrates a modular grid foundation system. The modular grid foundation system 600 can be formed by a plurality of foundation modules 100 coupled together via the locking lug 110 and/or the locking channel 112. The modular grid foundation system 600 can be formed by any number and/or arrangement of foundation modules 100 coupled together.

The modular grid foundation system 600 can include a stanchion 200 disposed within one or more of the foundation modules 100 of the modular grid foundation system 600. The modular grid foundation system 600 can have a stanchion 200 received in each of the foundation modules 100 or in a predetermined arrangement of the foundation modules 100 depending on the requirements of the modular grid foundation system 600.

While FIG. 6 illustrates a module grid foundation system 600 having a plurality of foundation modules 100 arranged in two by two arrangement, it is within the scope of this disclosure to implement the modular grid foundation system 600 with any arrangement of foundation modules 100. Further, while a substantially square modular grid foundation system 600 is shown, the modular grid foundation system 600 can be formed in any arrangement and/or shape including, but not limited to, rectangular, ovular, circular, and/or a repetitive pattern (e.g. cross pattern, checkered pattern, etc.).

FIG. 7 illustrates a modular grid foundation system coupled with a wall panel. The modular grid foundation system 700 can include a plurality of wall panels 400 coupled with an exterior row of foundation modules 100 of the modular grid foundation system 700. The modular grid foundation system 700 can have a stanchion 200 received in each of the foundation modules 100 or in a predetermined arrangement of the foundation modules 100 depending on the requirements of the modular grid foundation system 700. The plurality of wall panels 400 can similarly receive a stanchion 200 therein.

As can be appreciated in FIG. 7, the plurality of wall panels 400 can each couple sequentially with a corresponding foundation module 100 with the locking lug 110 or the locking channel 112 and the plurality of wall panels 400 can coupled one to the other respectively via the locking channel 414 and the locking lug 416.

Figure 8:
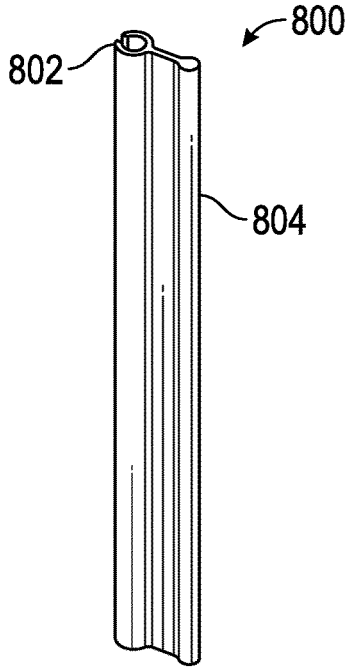
FIG. 8 is an isometric view of a linking panel, according to at least one instance of the present disclosure.
Figure 9:
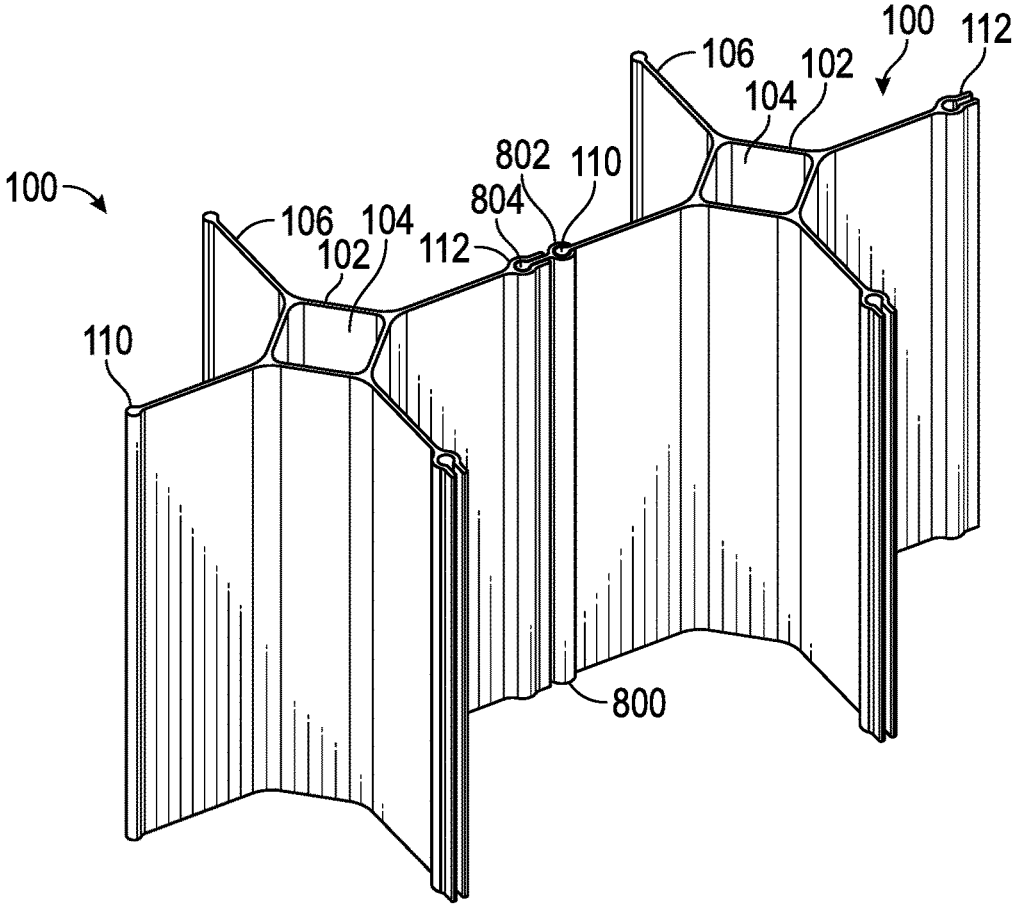
FIG. 9 is a top isometric view of two foundation modules coupled via a linking panel, according to at least one instance of the present disclosure.
Figure 10:
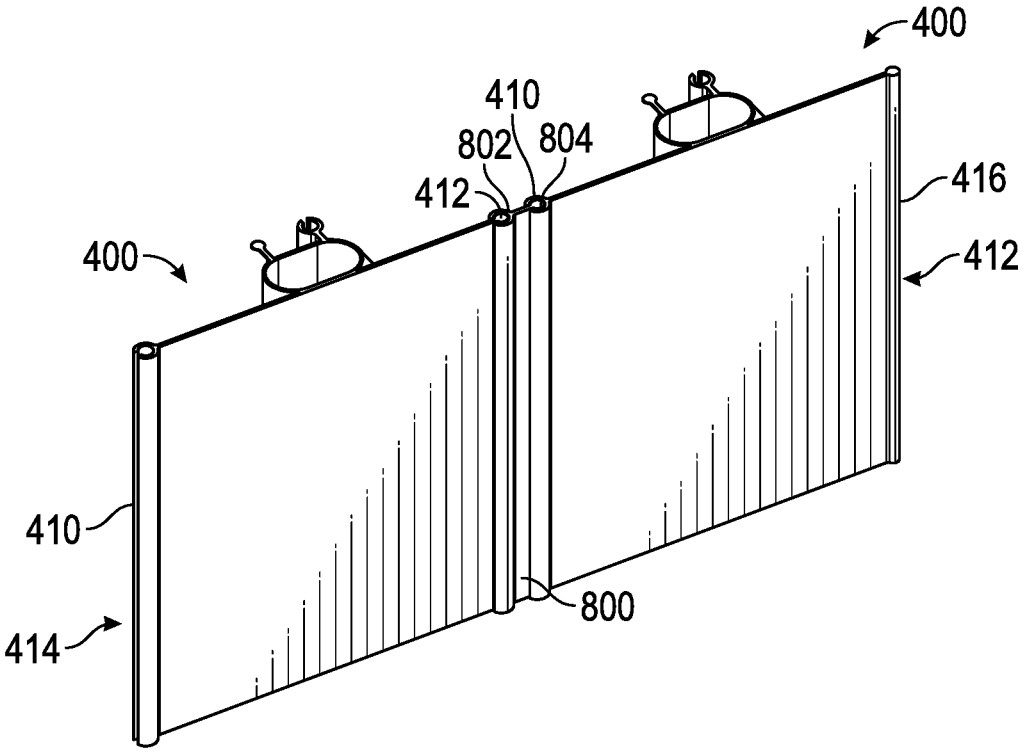
FIG. 10 is a top isometric view of a two wall panels coupled via a linking panel, according to at least one instance of the present disclosure.

FIGS. 8-10 illustrate a linking panel according to at least one instance of the present disclosure. The linking panel 800 can be formed by a laterally displaced locking channel 802 and locking lug 804. The linking panel 800 can allow adjacent foundation modules 100 and/or wall panels 400 to be coupled at arcuate angles. The locking channel 802 and the locking lug 804 can allow the modular foundation system 600 and/or 700 to form complex arcuate angles (as shown in FIG. 9). The locking channel 802 and the locking lug 804 can be laterally displaced by a predetermined distance, and the predetermined distance can determine the angular positioning of two adjacent foundation modules 100.

Figure 11:
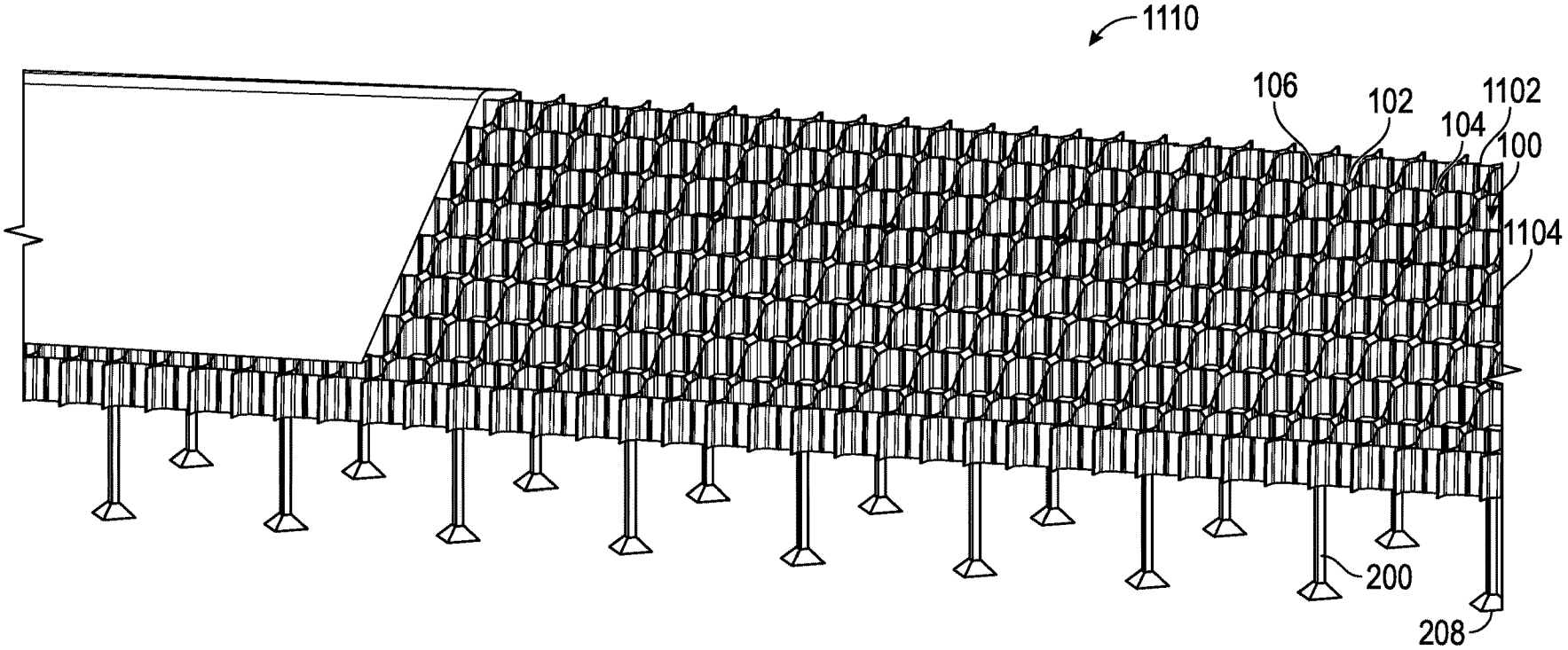
FIG. 11 is a side isometric view of a modular grid foundation wall coastal spine system, according to at least one instance of the present disclosure
Figure 12:
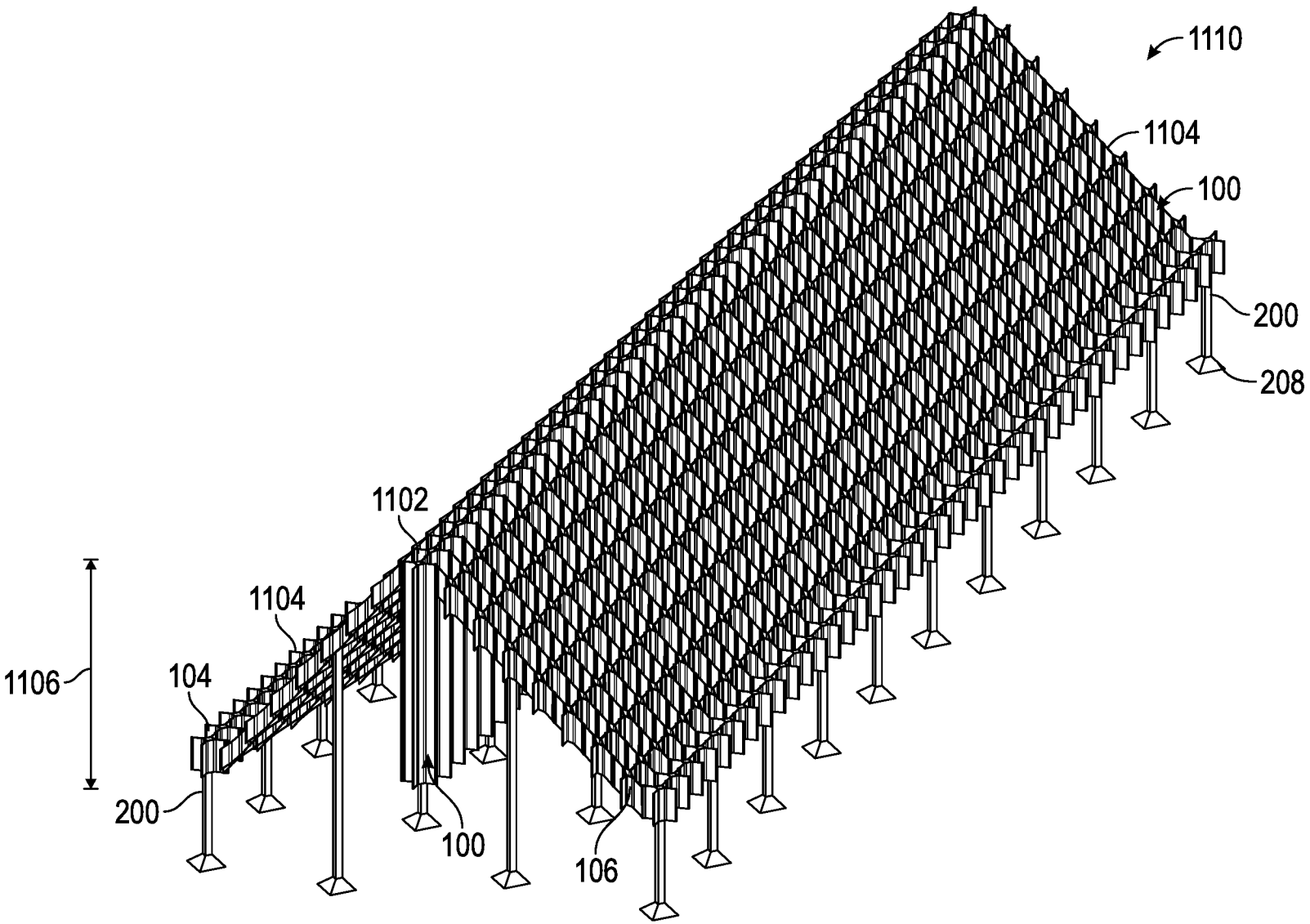
FIG. 12 is a top isometric view of a modular grid foundation wall coastal spine system, according to at least one instance of the present disclosure.

FIG. 11 is a side isometric view of a modular grid foundation wall coastal spine system. FIG. 12 is a top isometric view of a modular grid foundation wall coastal spine system. The coastal spine modular grid foundation system 1100 can be arranged to form a coastal spine through implementation of one or more of a plurality of modules 100, stanchions 200, wall panels 400, linking panels 800 and/or combinations thereof.

As can be appreciated with specific respect to FIGS. 11 and 12, the plurality of foundation modules 100 can extend above the surface of the earthen formation in any predetermined arrangement and/or heights. The coastal spine modular grid foundation system 1100 can have a substantially sloped pattern with respect to the plurality of foundation modules 100, such that interior foundation modules extend greater than exterior foundation modules. The substantially sloped pattern allow a plurality of spine modules 1102 to extend the predetermined height of the coastal spine, while tangential modules 1104 are cut and/or severed at a predetermined angled according to a desired slope of the coastal spine. In at least one instance, the tangential modules 1104 can extend the predetermined height of the coastal spine relative to the desired slope. In other instances (as shown in FIGS. 11 and 12), the tangential modules 1104 can have a predetermined length 1106 that extends less than the predetermined height of the coastal spine relative to the desired slope.

As can further be appreciated by FIGS. 11 and 12, the coastal spine modular grid foundation system 1100 can filled with material for form a berm, seawall, and/or other barrier. In at least one instance, the coastal spine modular grid foundation system 1100 can be filled with sand to encourage natural plant growth, while maintaining the appearance of a natural barrier sand dune. The coastal spine modular grid foundation system 1100 can have a plurality of stanchions 200 coupled therewith in a predetermined pattern and/or arrangement. In at least one instance, the coastal spine modular grid foundation system 1100 can have a stanchion 200 coupled with every fourth, fifth, sixth, or any number of modules 100 of the plurality of modules 100. In other instances, the coastal spine modular grid foundation system 1100 can have a stanchion 200 coupled with each and every module 100 of the plurality of modules 100. In yet other instances, each of the plurality of spine modules 1102 can have a stanchion 200 received therein while the plurality of tangential modules 1104 can have stanchions 200 disposed within a portion thereof in a predetermined pattern and/or grid.

In other instances, the coastal spine modular grid foundation system 1100 can be filled at least partially with concrete and/or cement to increase strength and covered with sand.

Figure 13:
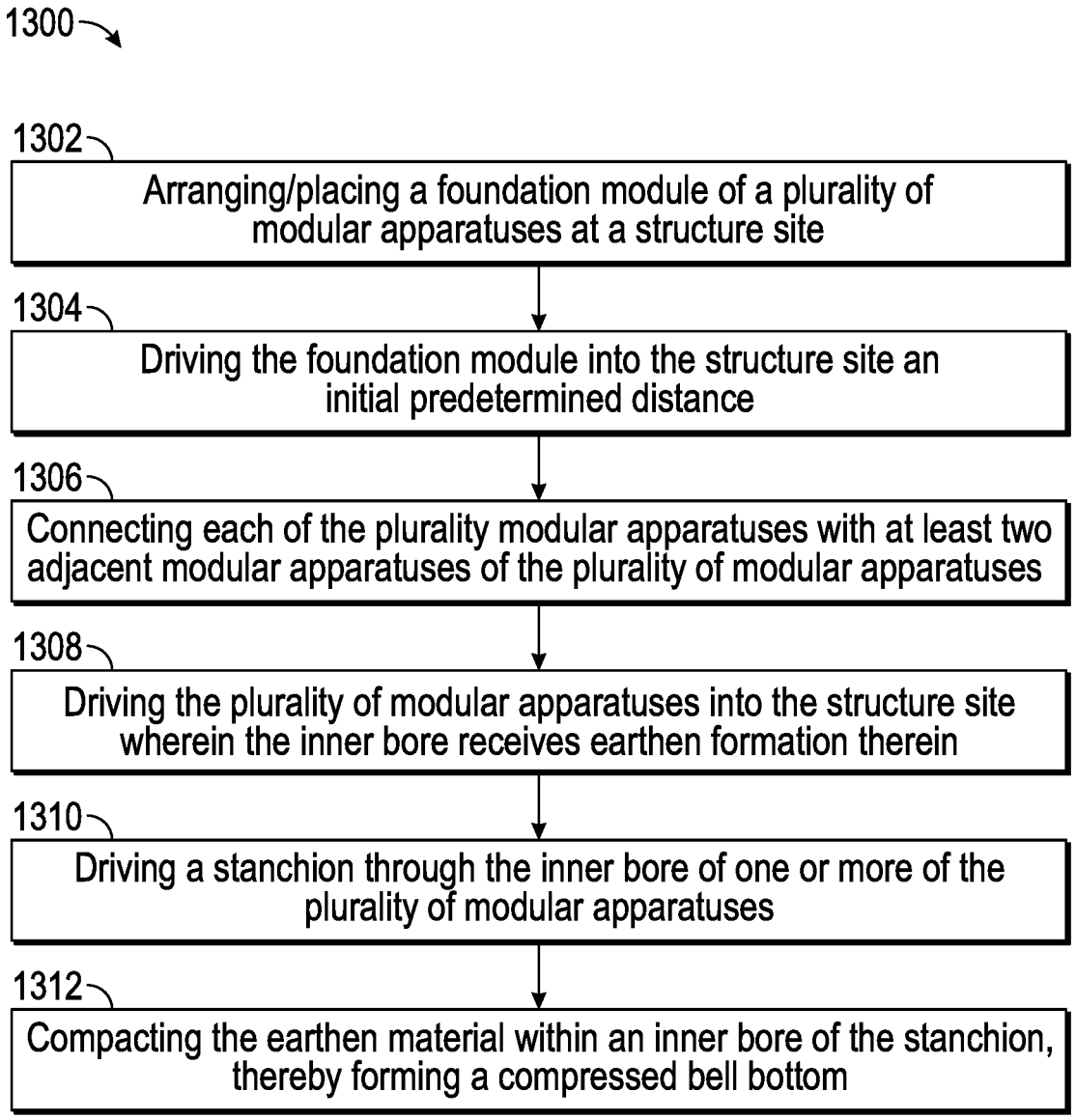
FIG. 13 is a flow chart of an installation method for a modular grid foundation system, according to at least one instance of the present disclosure.

In other instances, the coastal spine modular grid foundation system 1100 can have a plurality of modules 100 in a substantially stair stepped FIG. 13 is a flow chart of an installation method for a modular grid foundation system, according to at least one instance of the present disclosure. The method 1300 can be implemented with respect to the apparatus and/or systems described in FIGS. 1-12, and while specific processes are described below, no specific order is intended and/or implied. Further, additional processes, sub-processes, and/or methods can be implemented within method 1300 without deviating from this disclosure. The method can begin at block 1302.

At block 1302, a foundation module 100 can be placed in a predetermined location on the surface of an earthen formation. The foundation module 100 can be have a predetermined length extending substantially vertically above the surface of the earth once arranged in the predetermined location. The method 1300 can then proceed to block 1304.

At block 1304, the foundation module 100 is driven into the earthen formation to an initial predetermined distance. The initial predetermined distance can be one to ten feet, thereby allowing the foundation module 100 to stand substantially vertically without assistance. The method 1300 can then proceed to block 1306.

At block 1306, a plurality of foundation modules 100 can be coupled the foundation module via one or more coupling mechanisms. The plurality of foundation modules 100 can be arranged in a predetermined grid pattern with adjacent foundation modules 100 coupled via a locking channel and a locking lug, respectively. The method 1300 can then proceed to block 1308.

At block 1308, the plurality of foundation modules 100 arranged in the predetermined grid arrangement can be sequentially driven by mechanical force into the earthen formation. In some instances, upon installation of the plurality of foundation modules 100 to a predetermined depth and/or a predetermined mechanical force, the foundation modules 100 can be cut and/or severed at a predetermined height relative to the surface of the earthen formation. The method 1300 can then proceed to block 1310.

At block 1310, a stanchion can be received into an inner bore 104 formed through a central tubular member 102 of the foundation module 100. The stanchion 200 can be driven into the earthen formation via mechanical force along the length of the inner bore 104, and in some instance can extend into the earthen surface below the depth of the foundation module 100. Due to the shape/arrangement of the stanchion relative to the foundation module 100, the stanchion can be driven further into the earthen formation, thereby further securing the predetermined grid of the plurality of foundation modules 100. The stanchion 200 can be cut and/or severed to be substantially flush with the top of the foundation module. A stanchion can be driven through the inner bore 104 of each of the plurality of foundation modules 100, or a predetermined number, arrangement, and/or pattern of the plurality of foundation modules 100. In at least one instance, a stanchion is implement in every third foundation module 100 within the predetermined grid. The method 1300 can then proceed to block 1312.

At block 1312, earthen material can be compacted and/or compressed through an inner bore formed within the stanchion 200. The earthen material can thereby form a compressed bell bottom at distal end (subsurface) of the stanchion.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A method of building a grid system, said method comprising:

arranging a plurality of modular apparatuses at a structure site, the plurality modular apparatuses having a central tubular member having an inner bore formed along a longitudinal length between a proximal end and a distal end, and a plurality of vanes having a lateral width at least equal to a diameter of the central tubular member and extending substantially the length of the tubular member, wherein the one or more modular apparatuses are positioned above a surface of the structure site operable to receive one or more structures erected thereon;

connecting each of the plurality modular apparatuses with at least two adjacent modular apparatuses of the plurality of modular apparatuses, wherein the plurality of modular apparatuses are coupled via a locking lug on one of the plurality of vanes slidingly engaged with a locking channel on the adjacent modular apparatus;

driving the plurality of modular apparatuses into the structure site wherein the inner bore receives earthen formation therein;

driving a stanchion through the inner bore of the central tubular member of at least one of the plurality of modular apparatuses; and compacting earthen material into an inner bore of the stanchion, thereby forming a compressed bell bottom at a distal end of the stanchion.

2. The method of claim 1, wherein the plurality of modular apparatuses are driven into the structure site until a predetermined force and/or a predetermined depth.

3. The method of claim 2, wherein the plurality of modular apparatuses are severed at a predetermined height above the structure site.

4. The method of claim 1, wherein the plurality of modular apparatuses are arranged with at least three modular apparatuses in an X-plane and at least three modular apparatus in a Y-plane, thereby forming a grid of at least three modular apparatuses by at least three modular apparatuses.

5. The method of claim 1, wherein the plurality of modular apparatuses are formed from a fiber reinforced polymer (FRP).

6. The method of claim 1, wherein the stanchion extends to a predetermined determine distance past the distal end of the modular apparatus.

7. The method of claim 1, wherein the compressed bell bottom is formed at a predetermined volume and/or density at which the earthen material enters refusal.

8. The method of claim 1, further comprising driving the stanchion through the inner bore of the central tubular member of a predetermined arrangement of the plurality of modular apparatuses.

9. A modular grid foundation system, comprising:

a plurality of modular foundation apparatuses, each modular foundation apparatus comprising:

a central tubular member having a longitudinal length extending between a proximal end and a distal end, the central tubular member having an inner bore formed along the longitudinal length, wherein the inner bore is operable to receive earthen material therein;

a plurality of vanes having a lateral width at least equal to a diameter of the central tubular member and extending substantially along the longitudinal length of the tubular member;

a locking lug disposed at a distal end of at least one of the plurality of vanes; and a locking channel disposed at a distal end of at least one of the plurality of vanes;

wherein the plurality of modular foundation apparatuses are coupled one to the other via a sliding engagement between the locking lug of a first modular foundation apparatus of the plurality of modular foundation apparatuses and the locking channel of a second modular foundation apparatus of the plurality of modular foundation apparatuses, wherein a stanchion is operably received through the inner bore of the central tubular member, wherein the earthen material is operable to be compacted into an inner bore of the stanchion, thereby forming a compressed bell bottom at a distal end of the stanchion.

10. The modular grid foundation system of claim 9, wherein the stanchion is driven into the structure site until a predetermined force and/or a predetermined depth.

11. The modular grid foundation system of claim 9, wherein the stanchion extends to a predetermined determine distance past the distal end of the modular foundation apparatus.

12. The modular grid foundation system of claim 9, wherein the stanchion extends to a predetermined determine distance past the proximal end of the modular foundation apparatus.

13. The modular grid foundation system of claim 9, wherein the plurality of modular foundation apparatuses are formed from a fiber reinforced polymer (FRP).

14. The modular grid foundation system of claim 9, wherein each of the plurality of modular foundation apparatuses has four vanes extending from the central tubular member at approximately ninety (90) degrees (°) relative to an adjacent vane.

15. The modular grid foundation system of claim 9, wherein the plurality of modular apparatuses are driven into the structure site until a predetermined force and/or a predetermined depth.

16. The modular grid foundation system of claim 9, wherein the compressed bell bottom is formed at a predetermined volume and/or density at which the earthen material enters refusal.

17. A modular foundation apparatus comprising:

a central tubular member having a longitudinal length extending between a proximal end and a distal end, the central tubular member having an inner bore formed along the longitudinal length, wherein the inner bore is operable to receive earthen material therein;

a plurality of vanes having a lateral width at least equal to a diameter of the central tubular member and extending substantially along the longitudinal length of the tubular member; and a locking lug disposed at a distal end of at least one of the plurality of vanes; and a locking channel disposed at a distal end of at least one of the plurality of vanes;

wherein a stanchion is operably received through the inner bore of the central tubular member, wherein the earthen material is operable to be compacted into an inner bore of the stanchion, thereby forming a compressed bell bottom at a distal end of the stanchion.

18. The modular foundation apparatus of claim 17, wherein the stanchion and the modular foundation apparatus are formed from a fiber reinforced polymer (FRP).

19. The modular foundation apparatus of claim 17, wherein the compressed bell bottom is formed at a predetermined volume and/or density at which the earthen material enters refusal.

* * * * *